US006637853B1

(12) United States Patent
Ahne et al.

(10) Patent No.: US 6,637,853 B1
(45) Date of Patent: Oct. 28, 2003

(54) FAULTY NOZZLE DETECTION IN AN INK JET PRINTER BY PRINTING TEST PATTERNS AND SCANNING WITH A FIXED OPTICAL SENSOR

(75) Inventors: Adam Jude Ahne, Lexington, KY (US); Brian Keith Owens, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/345,368

(22) Filed: Jul. 1, 1999

(51) Int. Cl.[7] ..... B41J 2/165
(52) U.S. Cl. ..... 347/19
(58) Field of Search ..... 347/19, 23; 400/74

(56) References Cited

U.S. PATENT DOCUMENTS

| | | | | |
|---|---|---|---|---|
| 4,177,471 A | * | 12/1979 | Mitchell | 347/37 |
| 4,178,595 A | | 12/1979 | Jinnai et al. | 347/7 |
| 4,328,504 A | | 5/1982 | Weber et al. | 347/14 |
| 4,540,990 A | * | 9/1985 | Crean | 347/19 |
| 4,587,411 A | | 5/1986 | Obstfelder et al. | 235/437 |
| 4,587,535 A | | 5/1986 | Watanabe | 347/23 |
| 4,796,035 A | | 1/1989 | Kawasaki et al. | 347/262 |
| 4,907,013 A | | 3/1990 | Hubbard et al. | 347/19 |
| 4,977,459 A | | 12/1990 | Ebinuma et al. | 358/296 |
| 5,038,208 A | | 8/1991 | Ichikawa et al. | 358/502 |
| 5,049,898 A | | 9/1991 | Arthur et al. | 347/19 |
| 5,069,556 A | | 12/1991 | Sasaki et al. | 400/74 |
| 5,124,720 A | | 6/1992 | Schantz | 347/19 |
| 5,140,429 A | | 8/1992 | Ebinuma et al. | 358/296 |
| 5,160,946 A | | 11/1992 | Hwang | 347/16 |
| 5,189,521 A | | 2/1993 | Ohtsubo et al. | 358/296 |
| 5,206,668 A | | 4/1993 | Lo et al. | 347/6 |
| 5,296,876 A | | 3/1994 | Yamaguchi et al. | 347/23 |
| 5,319,389 A | | 6/1994 | Ikeda et al. | 347/19 |
| 5,343,231 A | | 8/1994 | Suzuki | 347/14 |
| 5,353,052 A | | 10/1994 | Suzuki et al. | 347/19 |
| 5,379,061 A | | 1/1995 | Yamaguchi et al. | 347/23 |
| 5,442,382 A | | 8/1995 | Pfeuffer | |
| 5,508,826 A | * | 4/1996 | Lloyd et al. | 347/19 |
| 5,587,728 A | | 12/1996 | Edgar | |
| 5,596,353 A | | 1/1997 | Takada et al. | |
| 5,650,804 A | | 7/1997 | Kawamura et al. | |
| 5,655,174 A | | 8/1997 | Hirst | |
| 5,736,996 A | | 4/1998 | Takada et al. | |
| 5,798,773 A | | 8/1998 | Hiramatsu et al. | |
| 6,003,980 A | * | 12/1999 | Sheinman et al. | 347/19 |
| 6,352,331 B1 | * | 3/2002 | Armijo et al. | 347/19 |

FOREIGN PATENT DOCUMENTS

| | | | | |
|---|---|---|---|---|
| EP | 0783973 A2 | * | 7/1997 | 347/19 |
| EP | 0881083 A2 | * | 2/1998 | B41J/2/51 |
| EP | 0863012 A1 | * | 9/1998 | B41J/2/165 |
| EP | 0 869 007 A2 | | 10/1998 | |
| EP | 0 894 634 A2 | | 2/1999 | |
| WO | WO 96/32266 | | 10/1996 | |
| WO | WO 99/08875 | | 2/1999 | |

OTHER PUBLICATIONS

Hewlett–Packard Co., "Data Sheet for IP DesignJet CP Series Printers," (Jun. 23, 1999).

* cited by examiner

*Primary Examiner*—Stephen D. Meler
*Assistant Examiner*—Julian D. Huffman
(74) *Attorney, Agent, or Firm*—Mark P. Crockett

(57) ABSTRACT

An apparatus for detecting faulty nozzles in an ink jet printer includes an ink jet print head having a plurality of ink jet nozzles disposed adjacent a print medium. The print head prints a reference image on the print medium formed by ink droplets ejected from many of the nozzles. The print head also prints individual test images corresponding to each nozzle by ejecting ink droplets from each of the nozzles separately and sequentially. A print head scan mechanism scans the print head in a first direction relative to the print medium as the test images are printed. A print medium advance mechanism moves the print medium in a second direction between the printing of the reference image and the printing of the test images, where the second direction is orthogonal to the first direction. In this manner, the apparatus leaves nonprinted areas on the print medium between the reference image and the individual test images. A fixed optical sensor detects light reflected from the print medium and generates a sensor signal based thereon. The sensor signal indicates a first state when the sensor detects light reflected from a test image or from the reference image, and a second state when the sensor detects light reflected from a nonprinted area. When the optical sensor is adjacent a test image position and the sensor signal does not indicate the first state, the processor generates a fault signal.

12 Claims, 4 Drawing Sheets

FAULTY NOZZLE DETECTION IN AN INK JET PRINTER BY PRINTING TEST PATTERNS AND SCANNING WITH A FIXED OPTICAL SENSOR

FIELD OF THE INVENTION

The present invention is generally directed to detecting faulty nozzles in an ink jet print head. More particularly, the invention is directed to automatically printing and inspecting a test pattern to detect whether any nozzles have malfunctioned.

BACKGROUND OF THE INVENTION

Ink jet printers form images on paper by ejecting ink droplets from an array of nozzles on a print head. During the operational lifetime of an ink jet print head, the nozzles can become clogged, thus blocking the ejection of ink from the nozzles. Although most current ink jet printers include mechanisms for clearing clogged nozzles, these mechanisms are not always successful, and nozzles remained clogged.

Generally, when printer driver software generates print data to be sent to the print head, the software typically assumes that all of the nozzles of the print head are functioning properly. Thus, the print data may address nozzles that are malfunctioning. If this be the case, pixels that should be printed by the malfunctioning nozzles will remain blank on the paper. The typical result is an unwanted horizontal strip of white space in a printed image. As more and more nozzles malfunction during a print head's lifetime, this situation becomes more and more noticeable in printed output.

Therefore, a system is needed for identifying malfunctioning ink jet nozzles and providing this information to a printer driver so that the printer driver can compensate for the malfunctioning nozzles when generating print data.

SUMMARY OF THE INVENTION

The foregoing and other needs are met by an apparatus for detecting faulty nozzles in an ink jet printer. The apparatus includes processor means for receiving print data and for generating print commands, scan commands, and advance commands based on the print data. The apparatus also includes an ink jet print head having a plurality of ink jet nozzles disposed adjacent a print medium. The print head receives the print commands from the processor means and ejects ink droplets from each of the nozzles separately and sequentially during discrete printing periods in response to the print commands, where only one nozzle prints during a discrete printing period. Thus, the apparatus prints individual test images corresponding to each nozzle. The test images are printed at test image positions which are separated from a reference position by corresponding predetermined reference distances.

The apparatus also includes a print head scan mechanism for receiving the scan commands from the processor means. In response to the scan commands, the print head scan mechanism moves the print head in a first direction relative to the print medium during the discrete printing periods. The apparatus has a print medium advance mechanism for moving the print medium in a second direction during a time interval occurring between the printing of the test images, where the second direction is orthogonal to the first direction. In this manner, the apparatus leaves nonprinted areas on the print medium between the individual test images.

The apparatus has a fixed optical sensor which is positioned adjacent the print medium and which is nonmovable in the first direction relative to the print medium. The optical sensor detects light reflected from the print medium and generates a sensor signal based thereon. The sensor generates the sensor signal indicating a first state when the sensor detects light reflected from one of the test images. The sensor generates the sensor signal indicating a second state when the sensor detects light reflected from one of the nonprinted areas.

After the apparatus prints the test images, the print medium advance mechanism moves the print medium in the second direction relative to the optical sensor, thereby causing the test images on the print medium to move sequentially adjacent the optical sensor in the second direction. As the print medium moves in the second direction relative to the optical sensor, the processor means receives the sensor signal from the sensor. When the optical sensor is adjacent a test image position and the sensor signal does not indicate the first state, the processor generates a fault signal.

Thus, the present invention prints a test image corresponding to each nozzle on the print head, and detects the test images using a fixed optical sensor, such as a typical media sensor. Since each nozzle is supposed to print a test image at a particular location, a missing test image indicates a malfunctioning nozzle. Further, the position of the missing test image relative to the reference position indicates which nozzle has malfunctioned. Since the test pattern is inspected automatically by the optical sensor, a user does not have to visually inspect a printed sample to detect faulty nozzles.

The use of a fixed optical sensor is advantageous since there is no need to place a sensor on a movable carriage. Further, there is no need to provide flexible electrical lines such as would be required to connect a movable sensor to circuits in the printer. Thus, the use of the fixed optical sensor to detect faulty nozzles significantly simplifies the design and reduces the cost of the printer as compared to a system that uses a scanning sensor.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE INVENTION

Figure 1:
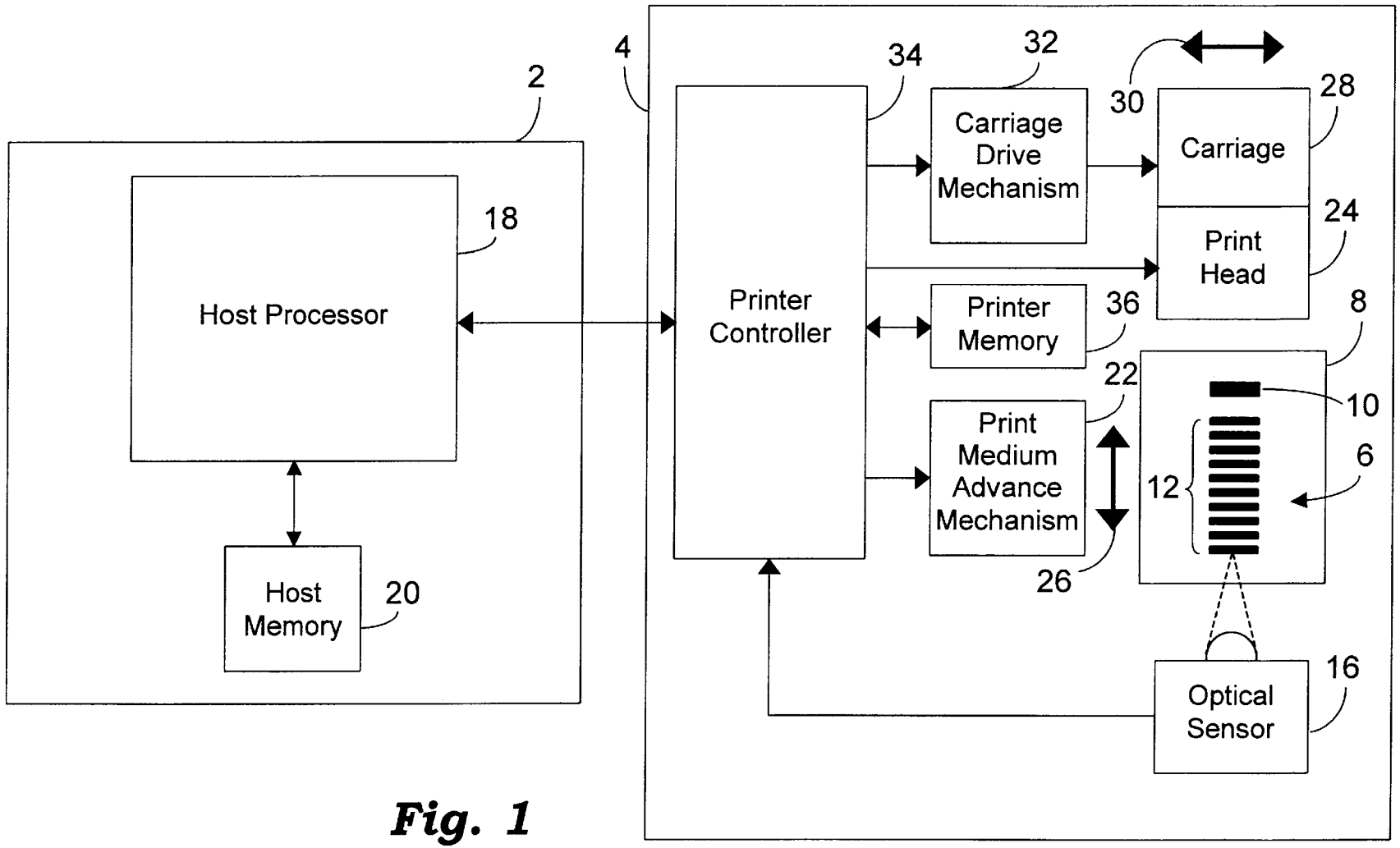
FIG. 1 is a block diagram of an apparatus for detecting faulty nozzles in an ink jet is printer according to a preferred embodiment of the present invention.

Depicted in FIG. 1 is a system for identifying malfunctioning ink jet nozzles and compensating for the malfunctioning nozzles during generation of print data. The system components include a host computer 2 and an ink jet printer 4. The configuration and operation of these components is described in more detail below. First, a broad overview of the invention is provided, followed by a more detailed description of the system operation.

As shown in FIG. 1, the host computer 2 generates print data that is sent to the printer 4. The print data includes information describing a test pattern 6 that is printed by the printer 4 on a print medium 8. Preferably, the test pattern 6 consists of multiple test images 12 printed in a vertical stack relative to a reference position. In the preferred embodiment of the invention, a reference image, such as a start bar 10 is printed at the reference position. Each of the test images 12 is printed by a separate nozzle on a print head 24 of the printer, such that there is a test image 12 corresponding to each nozzle. If a nozzle malfunctions, there will be no test image 12 printed corresponding to that nozzle, resulting in an empty location 14. An optical sensor 16 is used to inspect the test pattern 6 to detect any empty locations 14. As described in more detail below, the position of an empty location 14 is correlated to the faulty nozzle that should have printed a test image 12 in the empty location 14. The host computer 2 uses this information to modify the print data that is sent to the printer 4 in the future.

With continued reference to FIG. 1, the host computer 2 includes a host processor 18, such as a Pentium processor manufactured by Intel. Under the control of printer driver software, the host processor 18 generates print data that is sent to the printer 4 to create printed images. The host computer 2 also includes a host memory device 20, such as a random access memory (RAM) or a magnetic disk drive.

Figure 2:
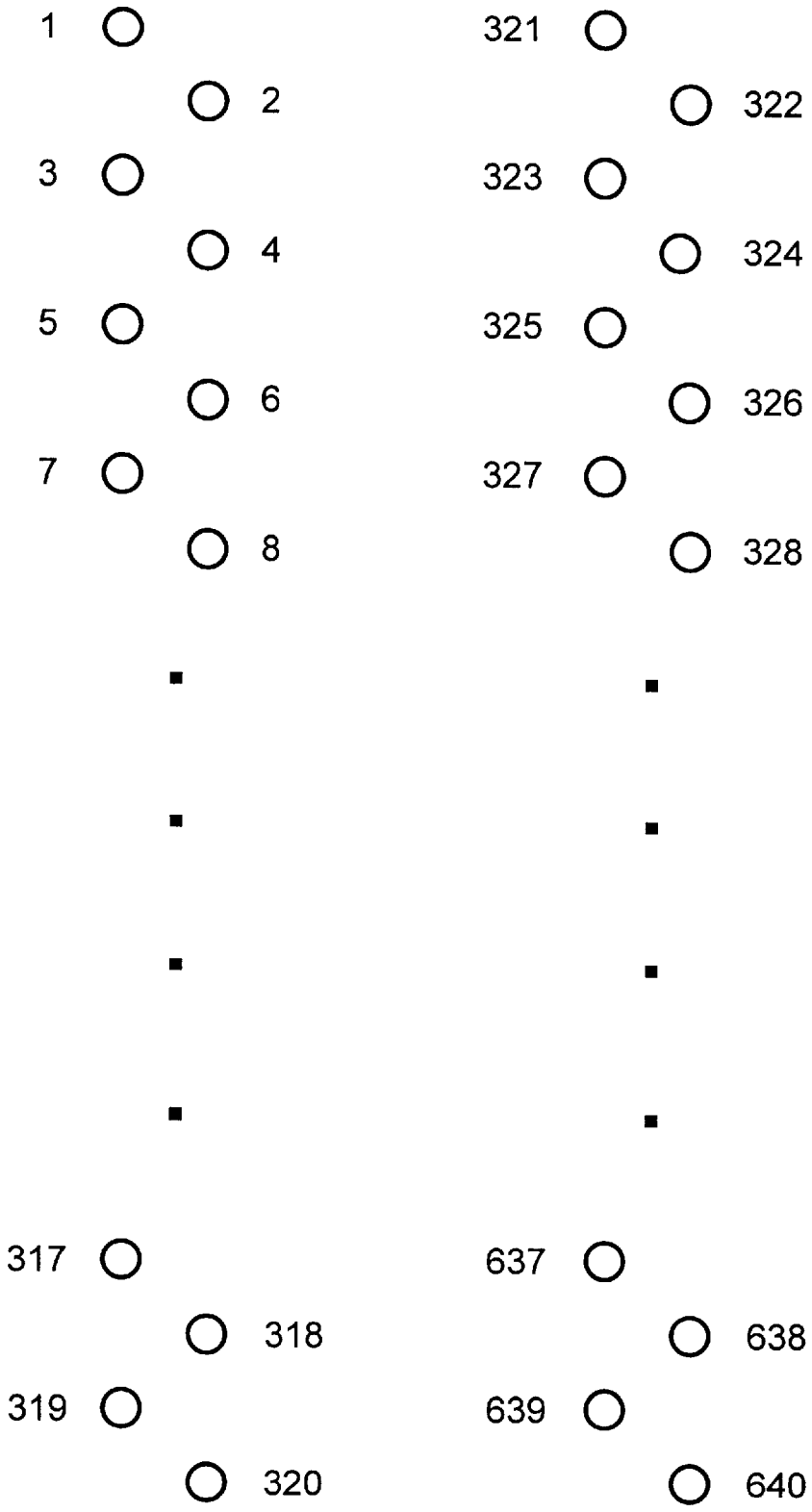
FIG. 2 depicts an array of nozzles on an ink jet print head according to a preferred embodiment of the present invention.

The printer 4 includes a print medium advance mechanism 22 for advancing the print medium 8, such as paper, relative to the print head 24. Preferably, the print medium advance mechanism 22 includes a motor that mechanically drives a roller to cause the print medium 8 to move in the direction indicated by the arrow 26. Hereinafter, the direction indicated by the arrow 26 is referred to as a first or vertical direction. The print head 24 includes an array of nozzles for ejecting droplets of ink onto the print medium 8, where each droplet of ink forms a dot on the medium 8. An exemplary array of nozzles is shown in FIG. 2. With reference again to FIG. 1, the printer 4 also includes a carriage 28 that is mechanically connected to the print head 24 for providing movement of the print head 24 adjacent the print medium 8. Preferably, the carriage 28 rides along a rail in the direction indicated by the arrow 30. Hereinafter, the direction indicated by the arrow 30 is referred to as a second or horizontal direction. A carriage drive mechanism 32 is mechanically coupled to the carriage 28 for driving the carriage 28 in the horizontal direction.

With continued reference to FIG. 1, the printer 4 includes a printer controller 34. The printer controller 34 is preferably a digital processor that receives the print data from the host processor 18 and generates printer commands based on the print data. As described in more detail hereinafter, the printer commands control the carriage drive mechanism 32, the print medium advance mechanism 22, and the print head 24 to produce the test pattern 6 on the print medium 8.

Figure 3:
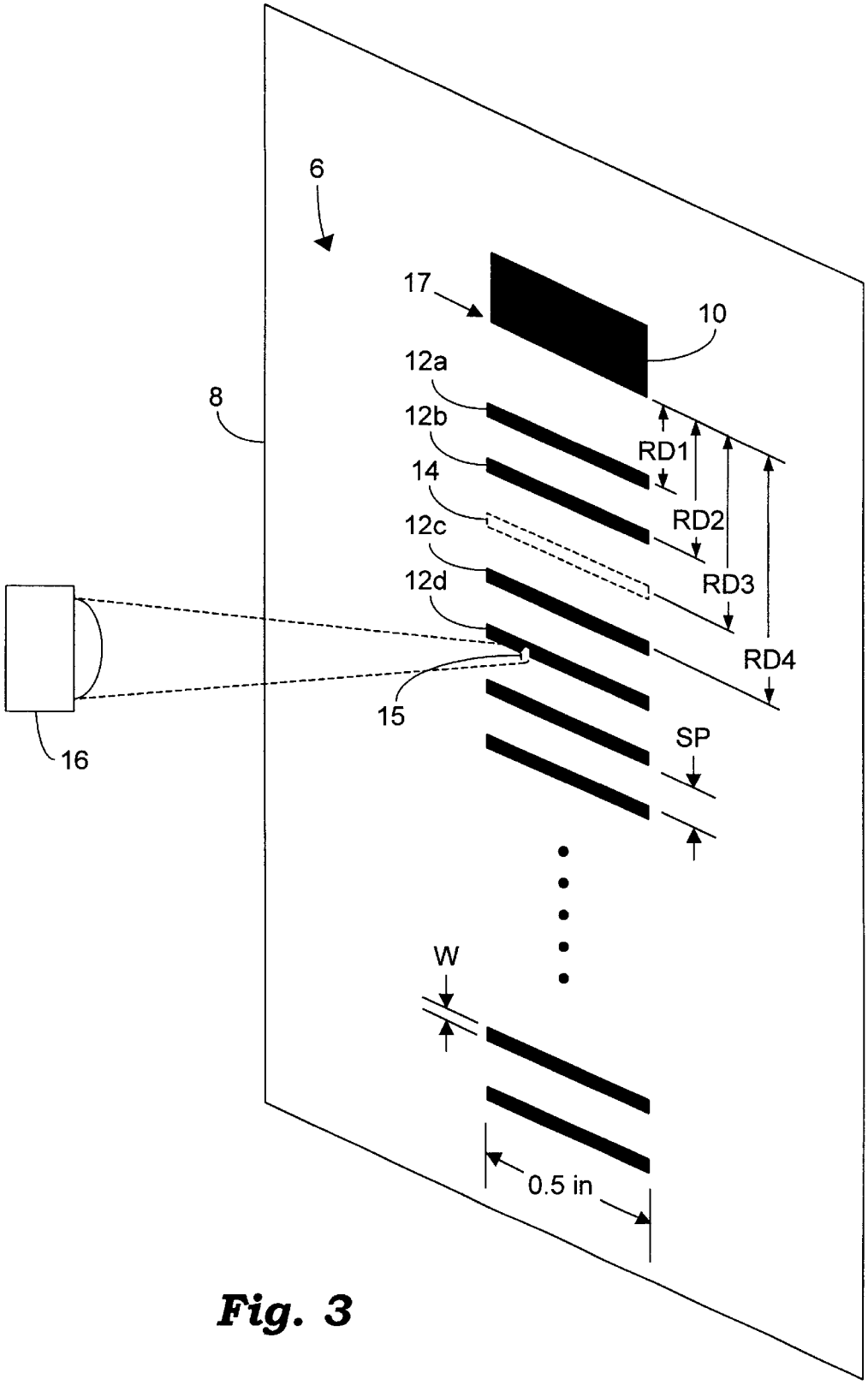
FIG. 3 depicts a test pattern on a print medium according to a preferred embodiment of the present invention.

The host processor 18 generates print data describing the test pattern 6 to be printed by the printer 4, such as the test pattern 6 shown in FIG. 3. The test pattern 6 is preferably a vertical stack of test images 12, with a single test image 12 corresponding to each nozzle of the print head 24. In the preferred embodiment, each test image 12 is a rectangular block having a length of about 0.5 inch and a width of W. As described in more detail below, the minimum width of the test images 12 depends on the optical resolution of the sensor 16. The minimum spacing between test images 12, SP, also depends on the optical resolution of the sensor 16. At the top of the stack is a start bar 10 that provides a reference point for determining the relative positions of the test images 12.

In the preferred embodiment of the invention, the host processor 18 transfers the print data describing the test pattern 6 to the printer controller 34. Based on the print data, the printer controller 34 generates scan commands, print commands, and advance commands to control the carriage drive mechanism 32, the print head 24, and the print medium advance mechanism 22, respectively. To print the start bar 10, the printer controller 34 generates print commands and scan commands to cause the print head 24 to fire many or all of its nozzles as the carriage drive mechanism 32 scans the print head across a 0.5 inch swath in the center of the print medium 8. Thus, the start bar 10 will be a substantially solid and dark after one scan, having a vertical width corresponding to the vertical extent of the nozzle array on the print head 24.

After printing the start bar 10, the printer controller 34 generates a scan command to return the print head 24 to the scan start position and generates an advance command to cause the print medium advance mechanism 22 to advance the print medium 8 by the width of the start bar 10 plus a distance RD1 (see FIG. 3). The controller 34 then generates print and scan commands to cause the print head 24 to continuously fire only nozzle 1 (see FIG. 2) as the carriage drive mechanism 32 scans the print head across an 0.5 inch swath in the center of the print medium 8. The controller 34 then generates an advance command to cause the print medium advance mechanism 22 to advance the print medium 8 by approximately the diameter of the ink droplets ejected by the nozzle 1, such as 1/600 inch. The controller 34 then generates print and scan commands to cause the print head 24 to again continuously fire nozzle 1 as the carriage drive mechanism 32 scans the print head across the same 0.5 inch swath. This process continues until the width of the test image 12*a* equals approximately W, where in the preferred embodiment, W is 0.1 inch.

After completion of the test image 12*a* printed using nozzle 1, the controller 34 generates an advance command to cause the print medium advance mechanism 22 to advance the print medium 8 by a distance SP, as shown in FIG. 3. The printer 4 then prints a test image 12*b* using only nozzle 2 according to a sequence similar to that described above for the nozzle 1 test image 12*a*. This process is repeated until each nozzle on the print head 24 has printed a test image 12. For a print head 24 having several hundred nozzles, more than one page of the print medium 8 will be required to complete the pattern 6. Each page on which the pattern 6 is printed will include the start bar 10 at the top.

As shown in FIG. 3, if a nozzle malfunctions, such as by clogging, an empty location 14 will result in the test pattern 6 because no test image 12 is printed by that nozzle. Thus, at a distance of RD3 from the start bar 10 there is an empty location 14 (represented by the dotted outline) instead of a test image 12. It will be appreciated that in an actual test pattern 6, there would be no dotted outline at an empty location 14, but only a blank space.

In a preferred embodiment of the invention, after the printer 4 has completed printing a page of the test pattern 6, the controller 34 generates a reverse command to cause the print medium advance mechanism 22 to reverse the direction of movement of the print medium 8. With this embodiment, the full length of the print medium 8 is automatically sent back through the print zone and repositioned to place the top edge of the start bar 10 adjacent the optical sensor 16 without user intervention. An alternative embodiment includes a drum or other rotational paper control mechanism that allows continuous looping of paper through the print zone.

In another embodiment, after a page of the test pattern 6 has been printed, the print medium advance mechanism 22 ejects the print medium 8 from the print path into a paper tray. The user then manually reloads the print medium 8 into the printer 4.

Preferably, the optical sensor 16 is a low-cost, low-resolution device, such as may typically be used in printers to detect the presence of a page of paper in the print path. Although, in the preferred embodiment, the optical sensor 16 is fixed to the printer housing at approximately the horizontal center of the print area, the invention is not limited by the location of the sensor 16. Whatever the selected location of the sensor 16 may be, the sensor 16 is fixed, and does not scan horizontally across the print medium 8 as the test pattern 6 is sensed.

In the preferred embodiment, the sensor 16 includes optical components, such as lenses, to focus the field of view of the sensor 16 to a focal point 15 on the surface of the print medium 8. When the print medium 8 is repositioned after the test pattern 6 is printed, the focal point 15 of the sensor 16 is located just above the top edge of the start bar 10. At this position, the sensor 16 detects light reflected from the unprinted area just above the start bar 10. When the sensor 16 detects an unprinted area, it generates an analog sensor signal having an amplitude of approximately 1V to 3V. Hereinafter, a sensor signal having an amplitude in this voltage range is referred to as a sensor signal having a second state.

To read the test pattern, the host processor 18, under control of the printer driver, sends a FIND START command to the printer controller 34. In response to the FIND START command, the controller 34 generates an advance command to cause the print medium advance mechanism 22 to advance the print medium 8 relative to the sensor 16. As the print medium 8 advances, the focal point 15 of the sensor 16 moves across the start bar 10. As the sensor 16 detects a printed area, such as the start bar 10, the sensor 16 generates an analog sensor signal having an amplitude of approximately 0V to 1V. Hereinafter, a sensor signal having an amplitude in this voltage range is referred to as a sensor signal having a first state. As the print medium 8 continues to advance, the focal point 15 of the sensor 16 moves into the unprinted area just below the start bar 10, and the sensor 16 again generates a sensor signal having the second state.

Figure 4:
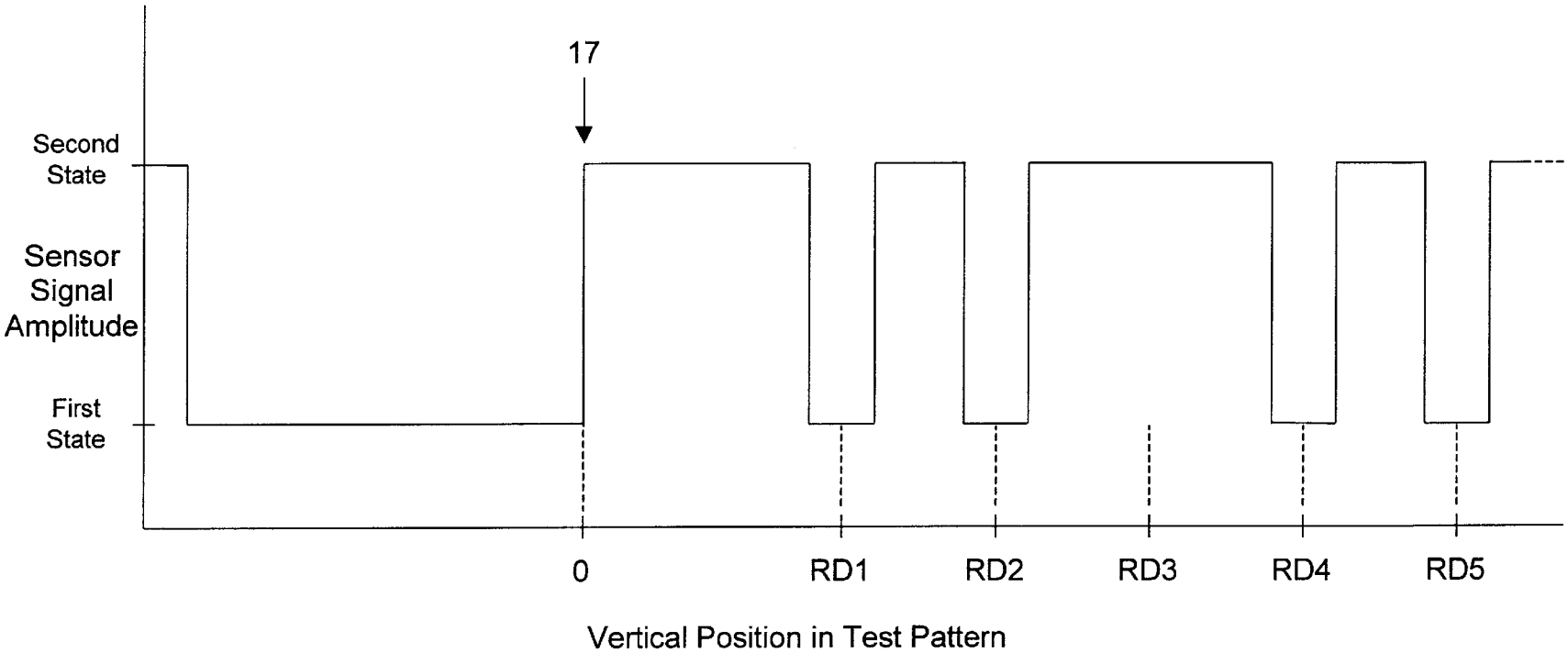
FIG. 4 depicts a sensor signal generated by an optical sensor as the test pattern moves adjacent to the optical sensor according to a preferred embodiment of the present invention.

Shown in FIG. 4 is an exemplary sensor signal such as would be generated by the sensor 16 as the focal point 15 moves across the test pattern 6. Preferably, the printer controller 34 receives the sensor signal from the sensor 16 and generates a sensor status bit based on the level of the sensor signal. The sensor status bit is either on, indicating a sensor signal having a first state, or off, indicating a sensor signal having a second state. The controller 34 transfers the sensor status bit to the host processor 18.

In the preferred embodiment, the bottom edge 17 of the start bar 10 (transition from second to first state) provides a reference or calibration position from which positions of the test images 12 can be determined. To find the bottom edge 17 of the start bar 10, the host processor 18 monitors the sensor status bit as the focal point 15 moves across the start bar 10. When the sensor status bit transitions from on to off, the host processor 18 sends a STOP command to the printer controller 34. In response, the printer controller 34 generates a command to cause the print medium advance mechanism 22 to stop advancing the print medium 8. The host processor 18 registers this position, which coincides with the bottom edge 17 of the start bar 10, as the reference or zero position in the test pattern 6. The invention uses the larger width of the start bar 10 to differentiate the start bar 10 from the test images 12.

In an alternate embodiment, an edge of the print medium 8 provides a reference or calibration position from which positions of the test images 12 can be determined. For example, after printing the test pattern 6, the print medium 8 may be repositioned to place the top edge of the print medium 8 just below the focal point of the sensor 16. The print medium 8 is then advanced relative to the focal point 15 until the focal point 15 coincides with the edge of the print medium 8. The transition in the level of the sensor signal as the focal point 15 moves over the edge of the print medium 8 indicates to the reference or zero position in the test pattern 6.

After finding the reference position, the host processor 18 sends a NEXT POSITION command to the printer controller 34. In response, printer controller 34 commands the print medium advance mechanism 22 to advance the print medium 8 by a distance RD1 from the zero position. As shown in FIG. 3, the focal point 15 of the sensor 16 should now coincide with the location of the test image 12*a* for nozzle 1. As shown in FIG. 4, when the focal point coincides with the test image 12*a* for nozzle 1, the sensor signal amplitude indicates the first state. At this point, the sensor status bit is on.

Based on the sensor status bit, the host processor 18 writes to a mask file to indicate the status of nozzle 1. Preferably, the mask file is simply a word having at least as many bits as there are nozzles on the print head 24. For example, for the 640-nozzle print head 24, the mask file consists of a word having at least 640 bits. The state of each bit in the word indicates the state of each nozzle in the print head 24. Preferably, the mask file is stored in the host memory device 20 for later access by the host processor 18 during generation of print data. Alternatively, the mask file is transferred to printer memory 36 for later access by the printer controller 34.

After updating the mask file, the host processor 18 again sends a NEXT POSITION command to the printer controller 34. In response, printer controller 34 commands the print medium advance mechanism 22 to advance the print medium 8 by a distance of RD2–RD1 from the RD1 position. As shown in FIG. 3, the focal point 15 of the sensor 16 should now coincide with the location of the test image 12*b* for nozzle 2. As shown in FIG. 4, when the focal point 15 coincides with the test image 12*b*, the sensor signal amplitude indicates the first state. At this point, the sensor status bit is again on, and the host processor 18 writes to the mask file to indicate the status of nozzle 2.

The host processor 18 then sends another NEXT POSITION command to the printer controller 34, which causes the print medium advance mechanism 22 to advance the print medium 8 by a distance of RD3–RD2 from the RD2 position. As shown in FIG. 3, the focal point 15 of the sensor 16 should now coincide with the location of a test image printed by nozzle 3. However, in the print head 24 of the current example, nozzle 3 has malfunctioned. Thus, at the distance RD3 from the zero position, the focal point 15 of the sensor 16 coincides with an empty location 14. As a result, the sensor signal indicates the second state, and the sensor status bit is turned off. Based on the sensor status bit, the host processor 18 writes to the mask file to indicate that nozzle 3 is faulty.

Preferably, the printer driver accesses the mask file when generating print data to be sent to the printer controller 34. Based on the mask file, the printer driver determines which of the nozzles on the print head 24 are good and which are faulty. If the mask file indicates is that one or more nozzles are faulty, the printer driver alters the print data to bypass the faulty nozzles. Thus, image pixels that would have been printed by the faulty nozzles are printed by one or more neighboring good nozzles.

It will be apparent to those skilled in the art that the above procedure of printing and scanning the test pattern 6, and generating the mask file can be performed automatically when the printer 4 has capability to re-feed the print medium 8 past the optical sensor 16. Thus, the invention can periodically perform these processes according to a testing and maintenance schedule without a need for user intervention. In this manner, the quality of the printed output from the printer 4 is automatically maintained as the print head 24 ages and nozzles fail.

It should be appreciated that the present invention is not limited to any particular method for determining the reference position in the test pattern 6. As described previously, the reference position may be determined based on the position of a start bar 10 or the position of an edge of the print medium 8. However, other methods of determining the reference position may be used. For example, differences in the relative widths of the individual test images 12 may be used to determine which nozzle printed a particular test image. In one alternate embodiment, each group of ten adjacent nozzles prints test images having incrementally increasing widths, where the differences in width from image to image is larger than the resolution of the optical sensor 16. For example, nozzle 1 prints a test image having a width of x inch, nozzle 2 prints a test image having a width of x +0.1 inch, nozzle 3 prints a test image having a width of x +0.2 inch, and so forth. This pattern of incrementally increasing test image width is repeated for each group of ten adjacent nozzles. If a nozzle fails to print a test image 12, the relative widths of test images 12 adjacent to the resulting empty position provides an indication of which nozzle (or nozzles) malfunctioned among the ten in the repeating pattern.

According to the preceding description, a printer driver running on the host processor 18 generates commands that control the printing and scanning of the test pattern 6. It will be appreciated, however, that the invention is not limited to generating these commands in the host processor 18. In an alternative embodiment, firmware in the printer controller 34 could control the generation and scanning of the test pattern 6 with minimal intervention from the host processor 18. In that embodiment, the printer driver on the host processor 18 may merely send a single command to initiate the test pattern printing and scanning process at preprogrammed times.

It is contemplated, and will be apparent to those skilled in the art from the preceding description and the accompanying drawings that modifications and/or changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. An apparatus for detecting faulty nozzles in an ink jet printer comprising:

processor means for receiving print data and for generating print commands, scan commands, and advance commands based on the print data;

an ink jet print head comprising a plurality of ink jet nozzles disposed adjacent a print medium, the print head for receiving the print commands from the processor means and for ejecting ink droplets from each of the nozzles in response to the print commands, thereby printing individual test images on the print medium at test image positions corresponding to each nozzle, where each test image is formed from ink ejected from one corresponding nozzle;

a carriage attached to the ink jet print head for enabling movement of the print head in a first direction relative to the print medium;

a print head scan mechanism attached to the carriage for receiving the scan commands from the processor means and moving the carriage and print head in the first direction relative to the print medium in response to the scan commands;

a print medium advance mechanism for receiving the advance commands from the processor means and moving the print medium in response to the advance commands in a second direction that is substantially orthogonal to the first direction, the movement of the print medium causing the test image positions to move individually and sequentially in the second direction into a field of view of a printed image sensor;

the printed image sensor positioned adjacent the print medium whereby the field of view of the printed image sensor intersects only one test image position at a time, the printed image sensor for detecting individual ones of the test images printed on the print medium as the test image positions advance individually and sequentially through the field of view in the second direction, and for generating a sensor signal indicating a first state when the printed image sensor detects one of the test images, and indicating a second state when the printed image sensor does not detect one of the test images, the printed image sensor being nonmovable in the first direction relative to the print medium; and the processor means further for receiving the sensor signal from the printed image sensor, for determining when an individual one of the test image positions is within the field of view of the printed image sensor, and for generating a fault signal when an individual one of the test image positions is within the field of view of the printed image sensor and the sensor signal does not indicate the first state.

2. The apparatus of claim 1 further comprising:

the ink jet print head for forming the test images at test image positions that are separated from a reference position by corresponding predetermined reference distances; and the processor means for identifying which of the nozzles is faulty based on the reference distance between the reference position and the test image position corresponding to the faulty nozzle, and for generating an identification signal indicative of which of the nozzles is faulty.

3. The apparatus of claim 2 further comprising:

the ink jet print head for printing a reference image at the reference position on the print medium, the reference image formed by ink droplets ejected from a plurality of the nozzles; and the processor means for identifying which of the nozzles is faulty based on the reference distance between the reference image and the test image position corresponding to the faulty nozzle.

4. The apparatus of claim 2 further comprising:

a status array memory device for storing a status array comprising status values which are indicative of a condition of each of the plurality of nozzles; and the processor means further for updating the status array based on the identification signal.

5. The apparatus of claim 4 further comprising a printer driver for accessing the status array memory device, for determining which of the plurality of nozzles are not faulty based on the status array, and for generating print data for activating only the nozzles that are not faulty, where print data that would be directed to a faulty nozzle is rerouted to a nozzle that is not faulty.

6. An apparatus for detecting faulty nozzles in an ink jet printer comprising:

processor means for receiving print data and for generating print commands, scan commands, and advance commands based on the print data;

an ink jet print head comprising a plurality of ink jet nozzles disposed adjacent a print medium, the print head for receiving the print commands from the processor means and for ejecting ink droplets from each of the nozzles in response to the print commands, thereby printing individual test images on the print medium corresponding-to each nozzle, where each test image is formed from ink ejected from one corresponding nozzle, the print head for printing the test images at test image positions that are substantially aligned in a single column on the print medium;

a printed image sensor positioned adjacent the print medium and having,a field of view intersecting the column of test image positions on the print medium, the field of view coinciding with only one test image position at a time, the printed image sensor for detecting individual ones of the test images printed on the print medium as the test image positions advance individually and sequentially through the field of view, and for generating a sensor signal indicating a first state when the printed image sensor detects one of the test images, and indicating a second state when the printed image sensor does not detect one of the test images, the printed image sensor being nonmovable in a direction perpendicular to the column of test images;

a print medium advance mechanism for moving the print medium to cause the test positions on the print medium to move sequentially and individually through the field of view of the printed image sensor;

the processor means further for receiving the sensor signal from the printed image sensor, for determining when the printed image sensor is adjacent a test image position, for generating a fault signal when the printed image sensor is adjacent a test image position and the sensor signal does not indicate the first state, for identifying which of the nozzles is faulty based on the reference distance between the reference position and the test image position corresponding to the faulty nozzle, and for generating an identification signal indicative of which of the nozzles is faulty;

a status array memory device for storing a status array comprising status values which are indicative of a condition of each of the plurality of nozzles;

the processor means further for updating the status-array based on the identification signal; and a printer driver for accessing the status array memory device, for determining which of the plurality of nozzles are not faulty based on the status array, and for generating print data for activating only the nozzles that are not faulty, where print data that would be directed to a faulty nozzle is rerouted to a nozzle that is not faulty.

7. A method for detecting faulty nozzles in a print head of an ink jet printer, where the ink jet printer forms printed images on a print medium by ejecting ink droplets from the nozzles as the print head scans across the print medium in a horizontal direction, the printer including an optical sensor for sensing the printed images on the print medium, and including a print medium advance mechanism for moving the print medium in vertical direction, the method comprising the steps of:

(a) forming a test image on the print medium at a corresponding test position, the test image formed by ejecting ink droplets from a corresponding one of the nozzles;

(b) moving the print medium in the vertical direction to leave a nonprinted area;

(c) repeating steps (a) and (b) for each remaining nozzle on the print head to form on the print medium a single column of test images that are substantially aligned in the vertical direction;

(d) maintaining a limited field of view of the optical sensor such that the field of view intersects no more than one of the test positions at a time while remaining consistently aligned with the column of test positions;

(e) moving the print medium in the vertical direction relative to the optical sensor, thereby causing the test images and nonprinted areas to move individually and sequentially through the field of view of the optical sensor;

(f) individually detecting the test images and the nonprinted areas using the optical sensor while maintaining the optical sensor in a fixed position relative to the horizontal direction as the print medium is moved in the vertical direction relative to the optical sensor;

(g) generating a sensor signal with the optical sensor based on the detecting, the sensor signal indicating a first state when one of the test images is detected, and indicating a second state when one of the nonprinted areas is detected;

(h) determining whether the field of view of the optical sensor is intersecting one of the test positions as the print medium is moved in the vertical direction relative to the optical sensor;

(i) generating a fault signal when the field of view of the optical sensor is intersecting one of the test positions and the sensor signal does not indicate the first state;

(j) identifying which of the nozzles is faulty based at least in part on the fault signal; and (k) compensating for one or more nozzles that are faulty.

8. A method for detecting faulty nozzles in a plurality of nozzles in a print head of an ink jet printer, where the ink jet printer forms printed images on a print medium by ejecting ink droplets from the plurality of nozzles as the print head scans across the print medium in a first direction, the printer including an optical sensor having a field of view for sensing the printed images on the print medium, and including a print medium advance mechanism for moving the print medium in second direction that is substantially orthogonal to the first direction, the method comprising the steps of:

(a) forming a test image on the print medium at a corresponding test position, the test image formed by ejecting ink droplets from a corresponding one of the nozzles;

(b) moving the print medium in the second direction to leave a nonprinted area;

(c) repeating steps (a) and (b) for each remaining nozzle on the print head to form on the print medium a single column of test images that are substantially aligned in the second direction;

(d) moving the print medium relative to the optical sensor, thereby causing the test positions to move individually through the field of view of the optical sensor; and (e) generating a fault signal when the field of view of the optical sensor intersects any one of the test positions and the optical sensor does not sense a test image.

9. The method of claim 8 further comprising:

(f) ejecting ink droplets from one or more of the nozzles on the print head to form a reference image on the print medium;

(g) identifying which of the nozzles is faulty based on the fault signal and a distance between the reference image and the test position corresponding to the faulty nozzle.

10. The method of claim 8 further comprising:

(f) establishing a reference position on the print medium;

(g) identifying which of the nozzles is faulty based on the fault signal and a distance between the reference position and the test position corresponding to the faulty nozzle; and (h) generating an identification signal indicative of which of the nozzles is faulty.

11. The method of claim 10 further comprising the steps of:

(i) storing a status array comprising status values indicative of a condition of each of the plurality of nozzles; and (j) updating the status array based on the identification signal.

12. The method of claim 11 further comprising the steps of:

(k) accessing the status array memory device;

(l) determining which of the plurality of nozzles are not faulty based on the status array; and (m) rerouting print data that would be directed to a faulty nozzle to a nozzle that is not faulty.

* * * * *